US011373503B2

(12) United States Patent
Franklin

(10) Patent No.: US 11,373,503 B2
(45) Date of Patent: Jun. 28, 2022

(54) SYSTEM AND METHOD OF AUTOMATICALLY ALERTING A USER TO REMAIN AWAKE

(71) Applicant: James Vincent Franklin, Austell, GA (US)

(72) Inventor: James Vincent Franklin, Austell, GA (US)

( * ) Notice: Subject to any disclaimer, the term of this patent is extended or adjusted under 35 U.S.C. 154(b) by 0 days.

(21) Appl. No.: 17/218,151

(22) Filed: Mar. 30, 2021

(65) Prior Publication Data

US 2021/0304581 A1 Sep. 30, 2021

Related U.S. Application Data

(60) Provisional application No. 63/002,158, filed on Mar. 30, 2020.

(51) Int. Cl.
*G08B 21/06* (2006.01)
*G08B 29/20* (2006.01)

(52) U.S. Cl.
CPC ..... *G08B 21/06* (2013.01); *G08B 29/20* (2013.01)

(58) Field of Classification Search
None
See application file for complete search history.

(56) References Cited

U.S. PATENT DOCUMENTS

| | | | | |
|---|---|---|---|---|
| 7,062,059 | B1 * | 6/2006 | Bobisuthi | H04R 1/083 381/370 |
| 2014/0072136 | A1 * | 3/2014 | Tenenbaum | G08B 21/02 381/74 |
| 2016/0277825 | A1 * | 9/2016 | Johansson | H04R 1/1016 |
| 2018/0312109 | A1 * | 11/2018 | Lee | A61B 5/18 |
| 2019/0300000 | A1 * | 10/2019 | Nakahata | G06V 20/597 |
| 2020/0019236 | A1 * | 1/2020 | Parkinson | G06F 3/012 |

* cited by examiner

*Primary Examiner* — John F Mortell

(57) ABSTRACT

A system and method of automatically alerting a user to remain awake is able to automatically notify a user of a head tilt or other malposition of their head indicative of falling asleep, thereby preventing the user from falling asleep while driving or performing any other task requiring an alert operator. The method is provided with a headset, at least one inclination sensor, and an alerting system, wherein the inclination sensor receives a plurality of head inclination readings. The method is further provided with an allowable range of head inclination managed by the controller, thereby allowing a head tilt to be detected based on at least one abnormal reading from the plurality of head inclination readings. The controller generates a sleep warning in response to the abnormal reading, whereby the sleep warning is subsequently output by the alerting system, whereby the sleep warning is rendered as an alarm or notification.

12 Claims, 13 Drawing Sheets

SYSTEM AND METHOD OF AUTOMATICALLY ALERTING A USER TO REMAIN AWAKE

The current application claims a priority to the U.S. Provisional Patent application Ser. No. 63/002,158 filed on Mar. 30, 2020.

FIELD OF THE INVENTION

The present invention relates generally to wearable technology and feedback devices configured to prevent a user from falling asleep. More specifically, the present invention recites new means and methods for promoting wakefulness by monitoring the head position of a user for tilting or nodding indicative of said user falling asleep, wherein a notification is produced to return the user to full alertness.

BACKGROUND OF THE INVENTION

An objective of the present invention is to provide a sleep prevention device that prevents users from falling asleep while performing tasks such as driving. The sleep prevention device is provided as a wearable device which can be worn as an earphone to not obstruct with the user's activities or be a distraction. The sleep prevention device includes a comfortable universal design which can be worn on either ear and can be worn along with other eyewear such as eyeglasses or sunglasses. The sleep prevention device is designed to track the head movement of the user and monitor different variables such the head tilt to recognize when the user is falling asleep. The sleep prevention device utilizes an orientation detection system configured to detect when a user has fallen asleep, based on the presumption that an extreme inclination of the head indicates that a user has fallen asleep. When a predetermined threshold is met, the sleep prevention device triggers various alarms to wake the user up which include flashing lights, vibrations, and sounds. The sleep prevention device further includes a rechargeable battery able to power the sleep prevention functions of the present invention as well as other functions. The sleep prevention device can also be utilized as other wireless earphones to transmit audio signals to and from a wireless device such as a smartphone. A wireless module is integrated into the sleep prevention device to enable the wireless connection with the different wireless devices.

Additional advantages of the invention will be set forth in part in the description which follows, and in part will be obvious from the description, or may be learned by practice of the invention. Additional advantages of the invention may be realized and attained by means of the instrumentalities and combinations particularly pointed out in the detailed description of the invention section. Further benefits and advantages of the embodiments of the invention will become apparent from consideration of the following detailed description given with reference to the accompanying drawings, which specify and show preferred embodiments of the present invention.

DETAILED DESCRIPTION OF THE INVENTION

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment", "some embodiments", or "alternative embodiments" should be considered to be illustrating aspects of the present invention that may potentially vary in some instances and should not be considered to be limiting to the scope of the present invention as a whole.

Figure 1:
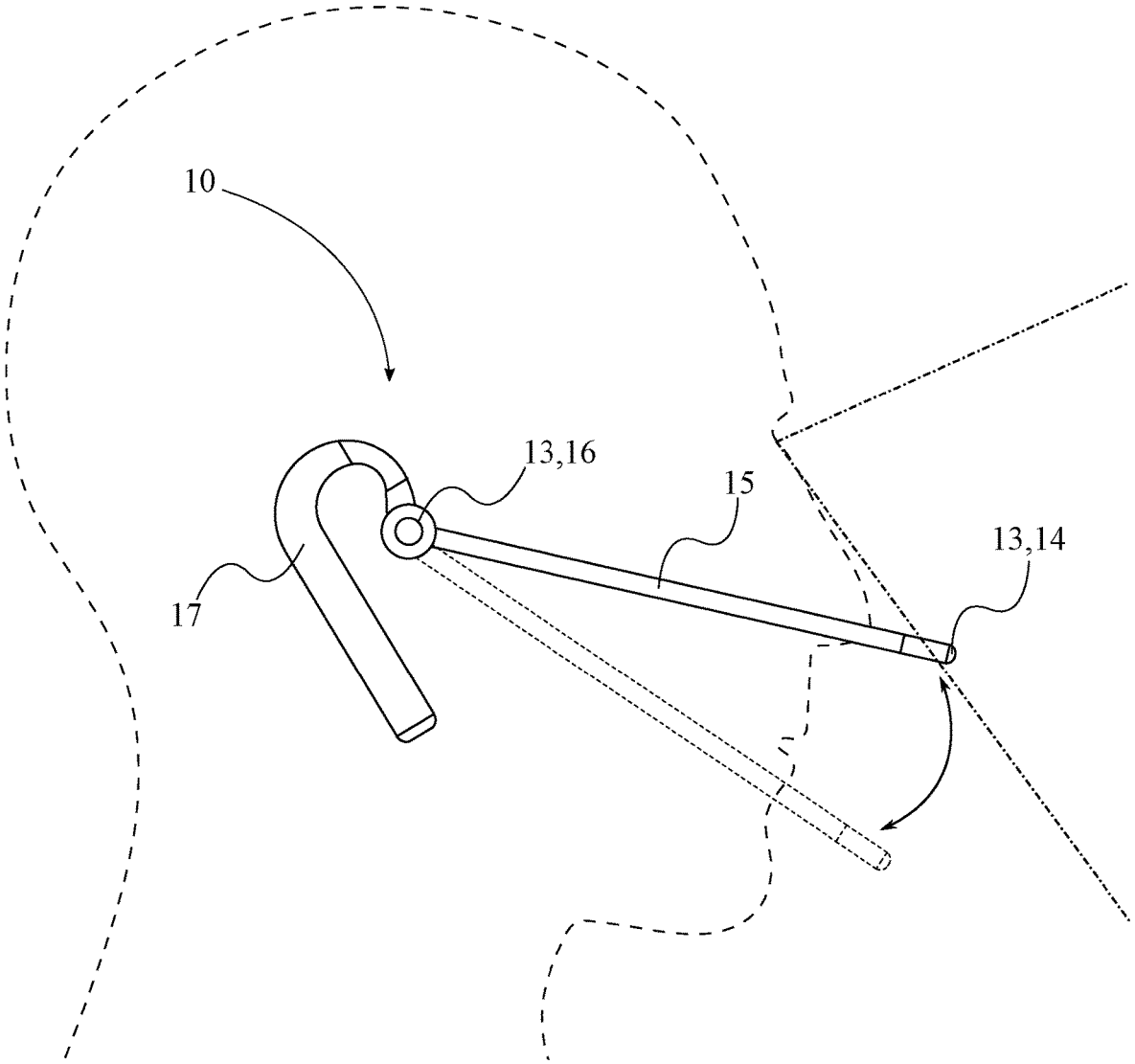
FIG. 1 is a schematic view of the system for the present invention, wherein the exemplary user is shown in silhouette.
Figure 2:
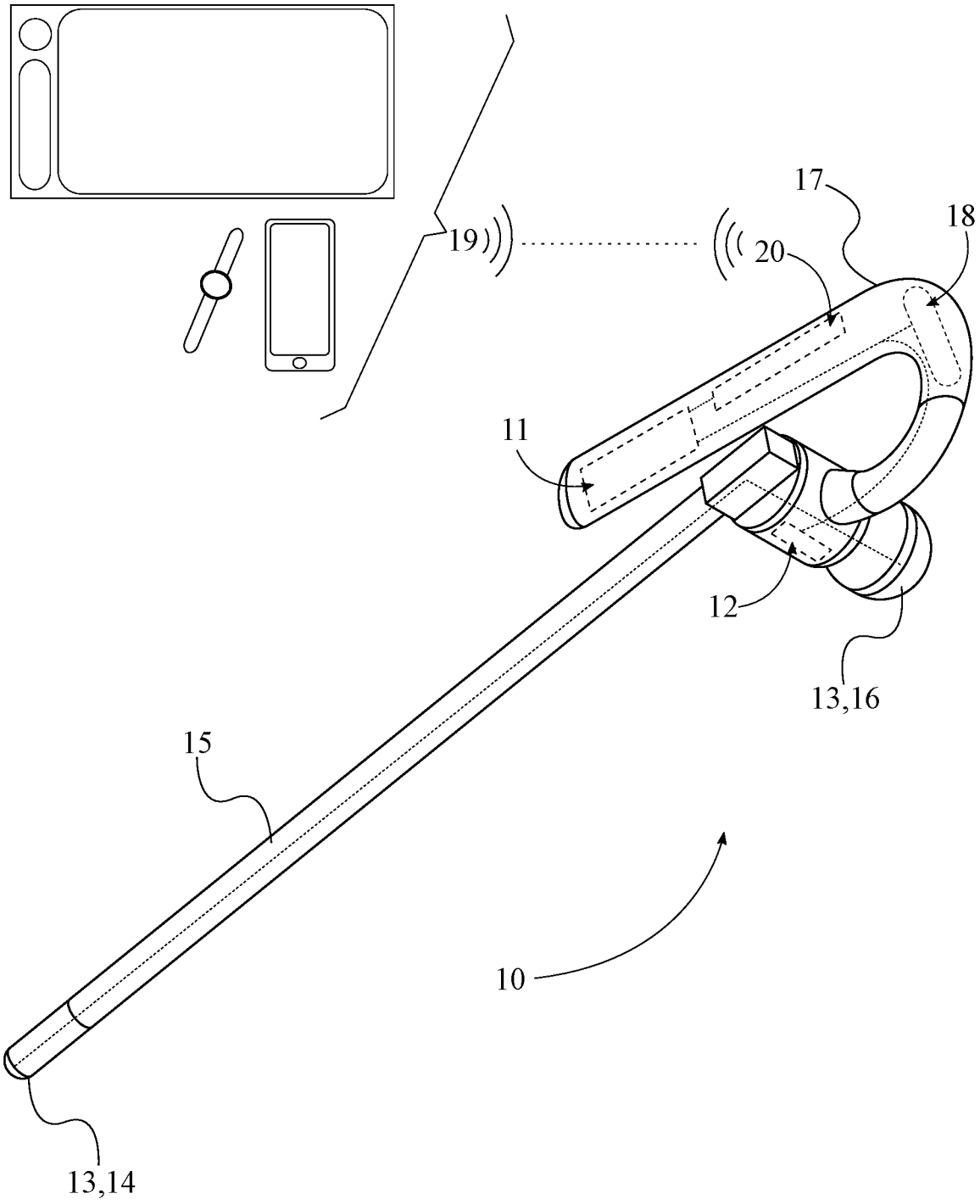
FIG. 2 is a perspective view of the system for the present invention, wherein the internal components of the present invention are shown in broken-line.

In reference to FIG. 1 through 13, the present invention is a system and method of automatically alerting a user to remain awake. The implementation of this method, either in a standalone article of wearable technology or as a novel integrated feature of existing articles, is proposed to reduce incidences of accidents resulting from drivers falling asleep at the wheel. Further, the present invention may be utilized in tandem to any task requiring extended periods of wakefulness wherein a user may require assistance or support to remain alert. To accomplish this, the present invention utilizes a headset 10 worn on a head of the user, wherein the headset 10 includes a controller 11, at least one inclination sensor 12, and an alerting system 13 (Step A) as illustrated in FIGS. 1 and 2. The headset 10 broadly refers to any article that may be worn on or about the head, specifically extending to include communications devices and other wearable technology already worn in this fashion. The controller 11 ideally refers to a programmable logic board or microcontroller, including any distributed analogue logical circuits in various alternate embodiments of the present invention. The inclination sensor 12 constitutes any known means of acquiring spatial and positioning data related to the orientation of the inclination sensor 12 extrinsic to the headset 10 in a readable form for the controller 11. In one embodiment, the inclination sensor 12 defines inertial measurement unit configured to detect attitudinal deviations from the horizon (i.e., from a perpendicular plane to an acceleration vector). In another embodiment, the inclination sensor 12 defines an analogue tilt switch such as a mercury switch. The alerting system 13 refers to any human interface device or media output system suitable for notifying a user to return to an upright, 'awake' posture. Accordingly, the controller 11 is electronically connected to the at least one inclination sensor 12 and the alerting system 13, which allows the controller 11 to readily communicate with the inclination sensor 12 and the alerting system 13. Moreover, an allowable range of head inclination is managed by the controller 11 and is defined as a manipulable constant within the controller 11, thereby enabling an individual user to individually calibrate the allowable range of head inclination to avoid erroneous activation of the alerting system 13.

Figure 3:
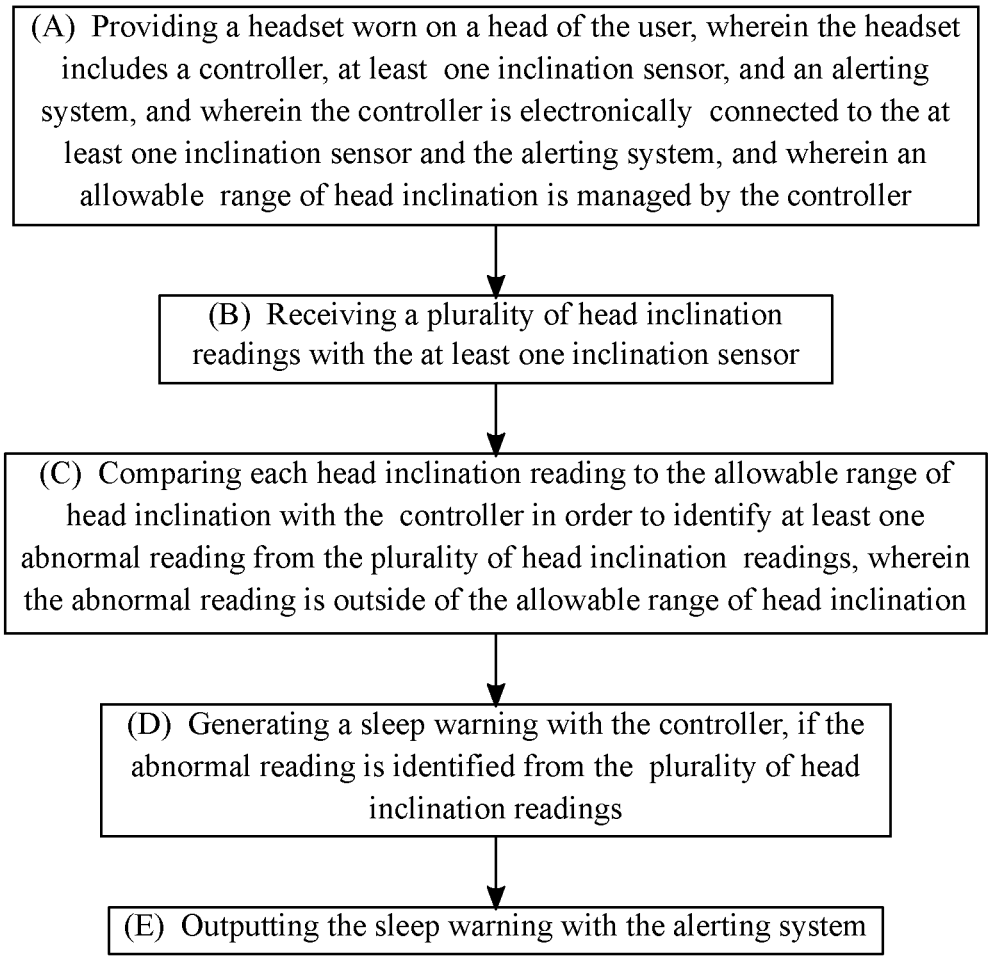
FIG. 3 is a flowchart illustrating the overall process of the present invention.

In reference to FIG. 3, the overall process followed by the method of the present invention allows the aforementioned components of the system to automatically alert a user to remain awake by employing a sleep-detection process and applying a corrective alert if a user appears to be dozing off. The overall process begins by receiving a plurality of head inclination readings with the at least one inclination sensor 12 (Step B). The plurality of head inclination readings constitutes a time-ordered collection of continuous readings from the inclination sensor 12 corresponding to the orientation of a user's head via the headset 10. The plurality of head inclination readings is broadly conceived to refer to any collection of such readings, including disparate readings collected across an extended period and momentary readings without departing from the original spirit and scope of the present invention.

Subsequently, each head inclination reading is compared to the allowable range of head inclination with the controller 11 in order to identify at least one abnormal reading from the plurality of head inclination readings, wherein the abnormal reading is outside of the allowable range of head inclination (Step C). The abnormal reading is defined by any output from the inclination sensor 12 to the controller 11 that deviates from the preconfigured range corresponding to normal head movement or orientation, i.e., the allowable range of head inclination. This deviation is proposed to be a suitable indication for drowsiness to be used as an indicator that a user has fallen or is falling asleep.

The overall process continues by generating a sleep warning with the controller 11 if the abnormal reading is identified from the plurality of head inclination readings (Step D). The abnormal reading may refer to a singular instance of deviation or may refer to a larger data set indicative of a protracted deviation dependent upon the allowable range of head inclination as defined by both position and time. Accordingly, the identification of the abnormal reading may constitute a prolonged observation of a deviation from the allowable range of head inclination or a singular deviation, dependent upon the configuration of the present invention. Further, the sleep warning defines an internal command or instruction stored within the controller 11 until said sleep warning is ready to be output through the alerting system 13.

Accordingly, the overall process concludes by outputting the sleep warning with the alerting system 13 (Step E), wherein the output of the alerting system 13 broadly refers to any user-detectable alert or notification as may be realized by an individual of ordinary skill. In practice, the user will ideally be awakened by the output sleep warning and either return to task as normal or seek to terminate said task (e.g., driving or operating other heavy equipment) as soon as feasible in recognition of their compromised state.

Figure 4:
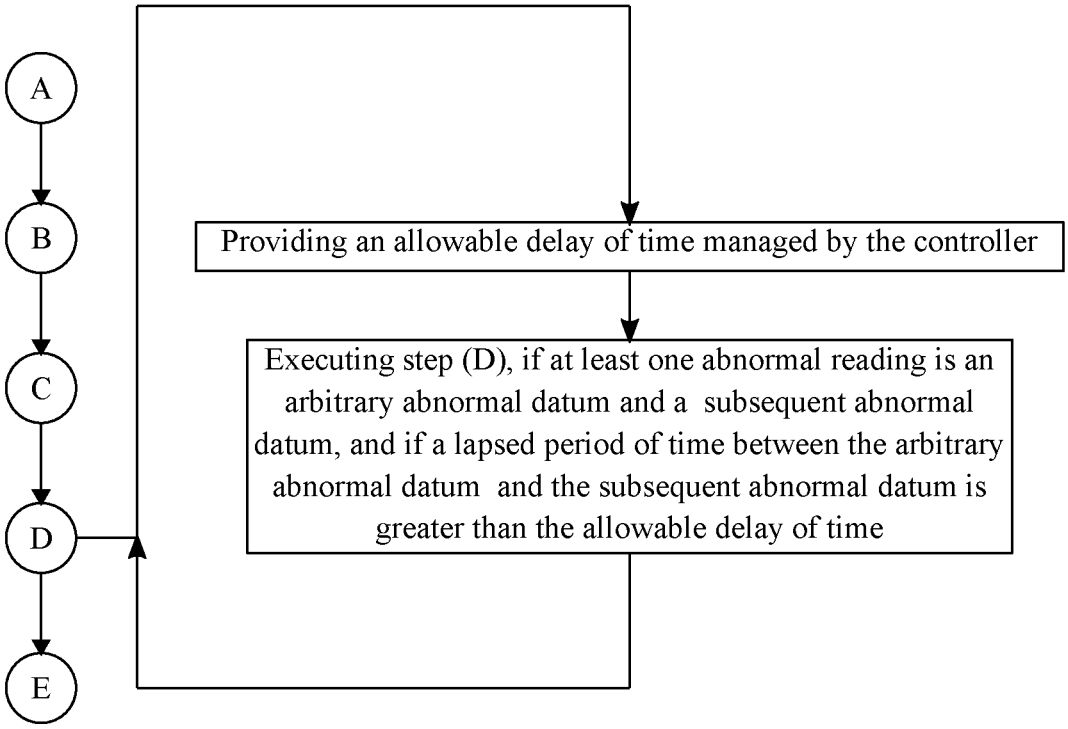
FIG. 4 is a flowchart illustrating a sub-process for instantiating a time-delay functionality into the overall process.

As outlined in FIG. 4, one subprocess for the method of the present invention is used to institute a margin for error between the detection of a positional deviation and the output of the sleep warning through the alerting system 13. Thus, the present invention is provided with an allowable delay of time managed by the controller 11, wherein the allowable delay of time is defined and configured by the user according to varying operating standards and use-cases. In this subprocess, at least one abnormal reading includes an arbitrary abnormal datum and a subsequent abnormal datum, wherein the arbitrary abnormal datum and the subsequent abnormal datum describe sequential outputs from the inclination sensor 12 indicating a protracted head tilt. If a lapsed period of time between the arbitrary abnormal datum and the subsequent abnormal datum is greater than the allowable delay of time, then Step D is executed.

Figure 5:
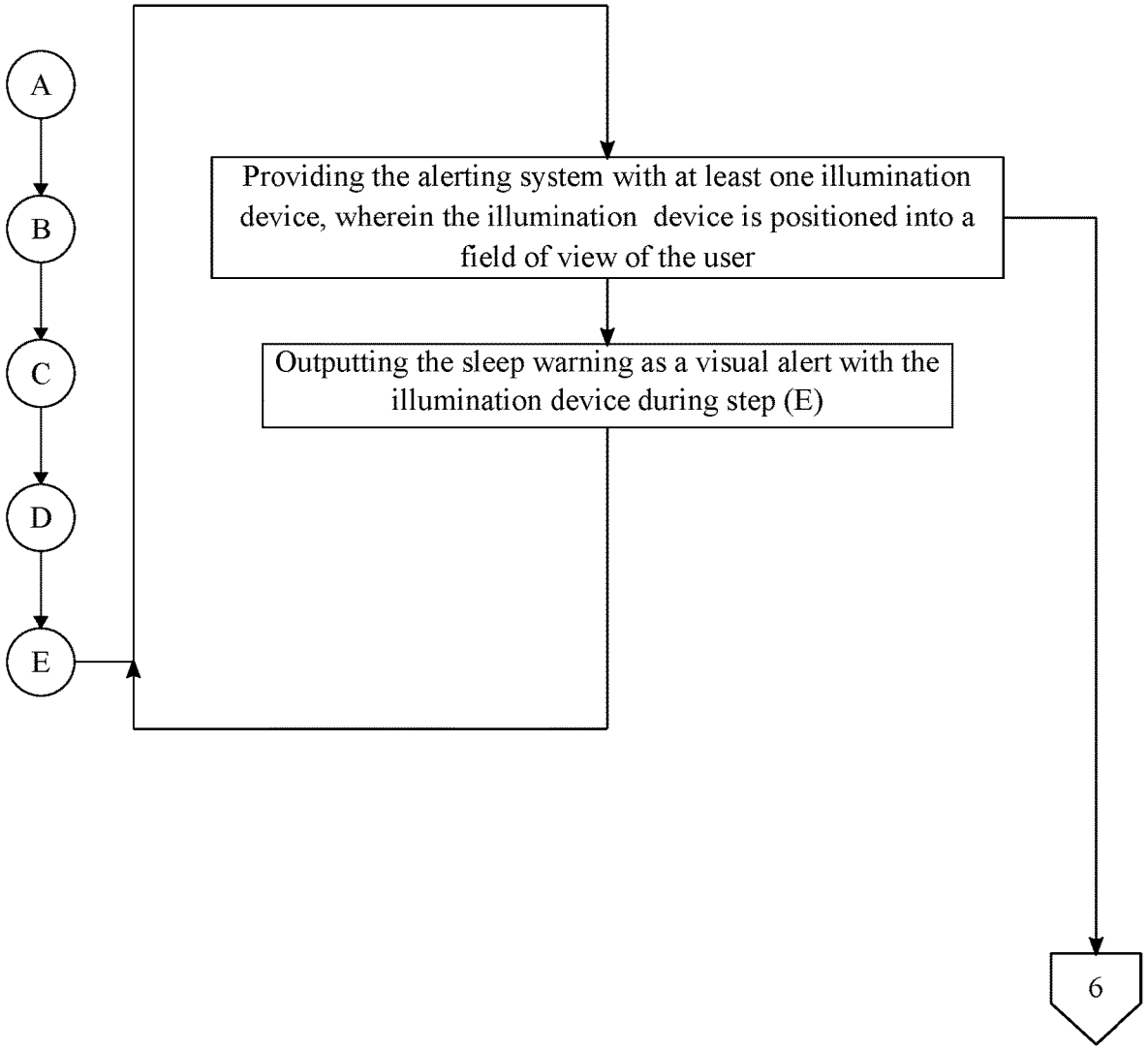
FIG. 5 is a flowchart illustrating a sub-process for creating a visual alert as part of an overarching alerting system.
Figure 6:
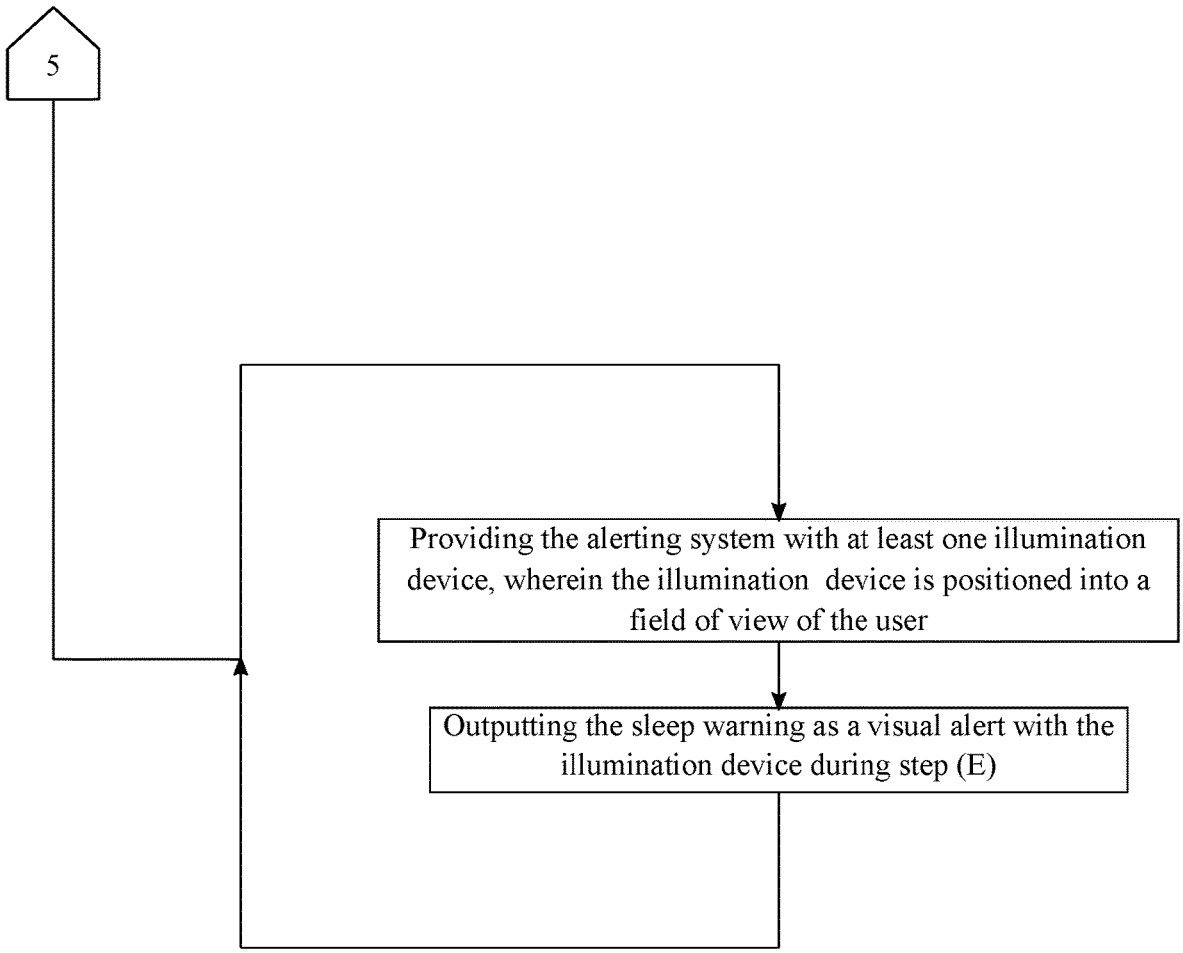
FIG. 6 is a flowchart illustrating a sub-process for positioning a support structure in the user's field of view to improve the efficacy of the visual alert.

Another subprocess enables the alerting system 13 to visually engage a user, providing the alerting system 13 with at least one illumination device 14 that is positioned into a field of view of the user as shown in FIG. 1 and outlined in FIG. 5. The illumination device 14 ideally defines a strobing, multicolored diode configured to output varying colors light across the visible spectrum. This configuration is particularly suitable to rouse a sleeping user, as the alternating light-dark and high-low frequency light is more disturbing (i.e., alerting) than static illumination. Accordingly, the sleep warning is output as a visual alert with the illumination device 14 during Step E in at least one embodiment.

This subprocess is further improved by providing the headset 10 with a boom 15, wherein the boom 15 defines a protruding stalk or spar extending from the headset 10 into the field of view of the user. The illumination device 14 is positioned into the field of view of the user with the boom 15 to ensure that the visual alert remains in effective range of the user's eyes as outlined in FIG. 6. The boom 15 may define a dedicated mounting component or an extant microphone mount across various embodiments, enabling the present invention to be integrated to existing wearable devices as previously outlined.

Figure 7:
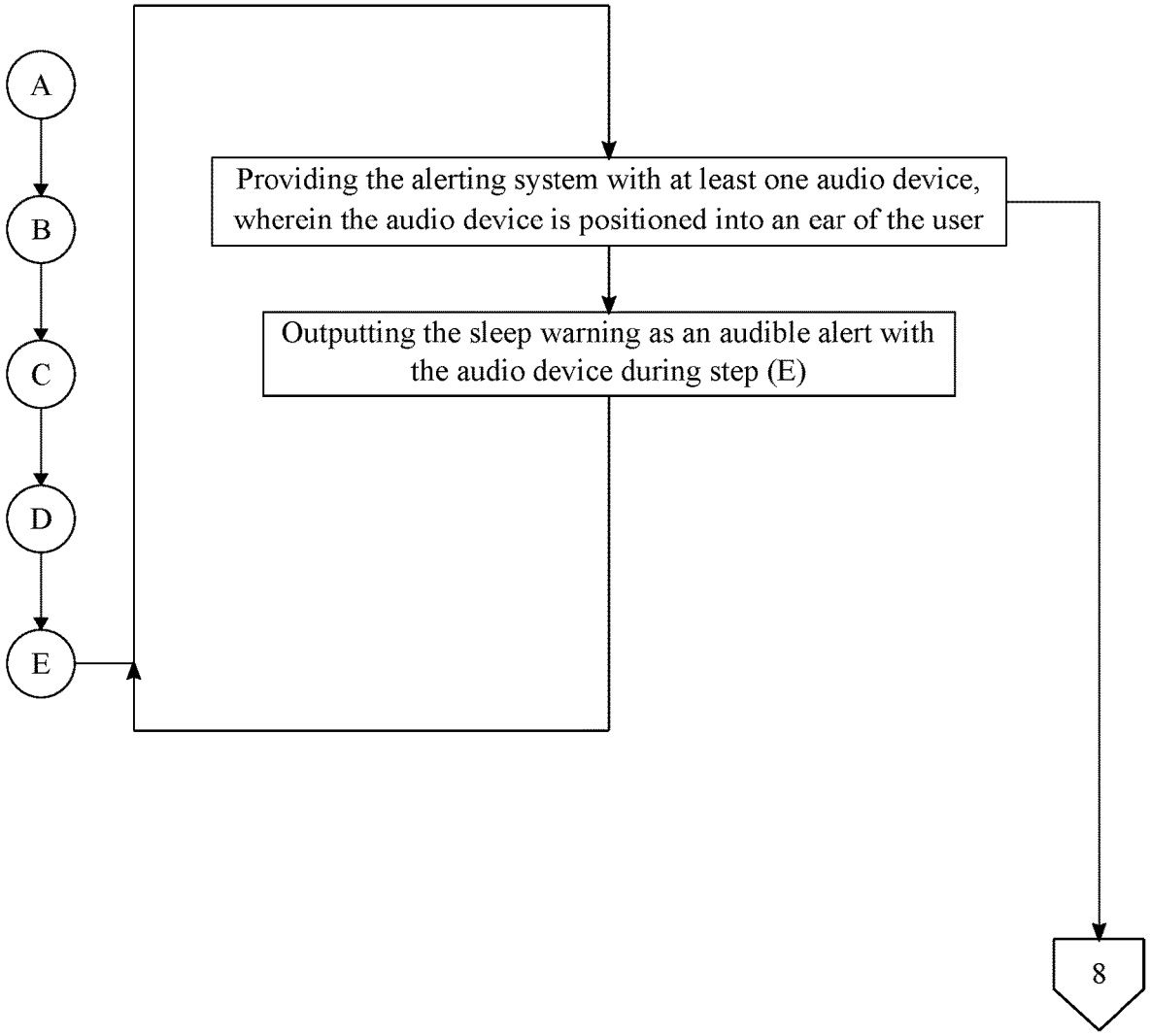
FIG. 7 is a flowchart illustrating a sub-process for creating an audible alert as part of an overarching alerting system.

Referring to FIG. 7, a further subprocess enables the alerting system 13 to engage a user audibly, providing the alerting system 13 with at least one audio device 16 positioned into an ear of the user. The audio device 16 broadly refers to any audio-playback device or speaker as may be realized by a person of ordinary skill. Accordingly, the sleep warning is output as an audible alert with the audio device 16 during Step E in at least one embodiment. As with the visual alert, the audible alert ideally defines a notification comprising a collection of varying pitches and sounds to ensure that a user cannot sleep through the audible alert once triggered.

Figure 9:
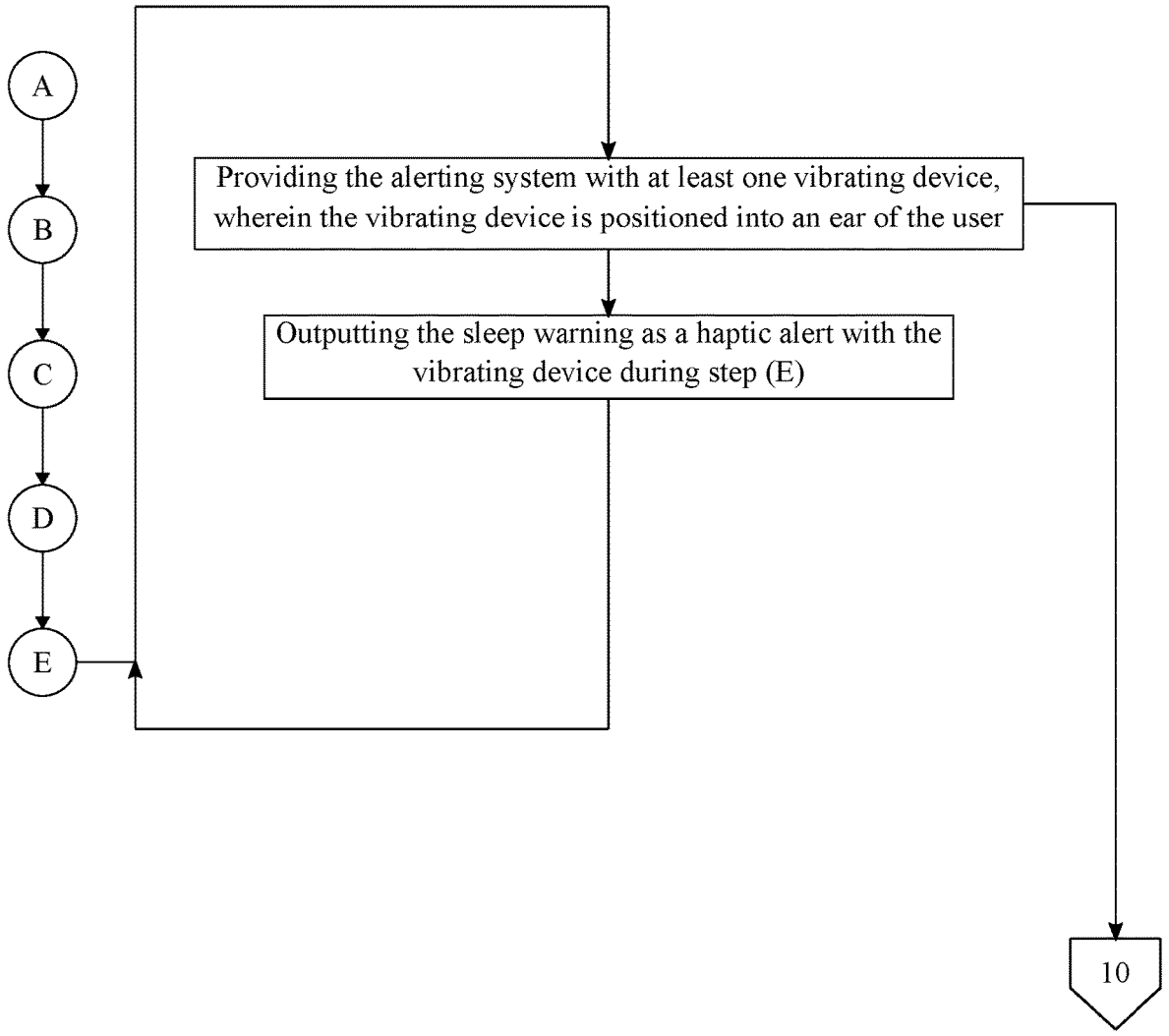
FIG. 9 is a flowchart illustrating a sub-process for creating a haptic alert as part of an overarching alerting system.

Referring to FIG. 9, another subprocess enables the alerting system 13 to engage a user physically, providing the alerting system 13 with at least one vibrating device 18 positioned into an ear of the user. The vibrating device 18 ideally refers to a miniaturized imbalanced motor, though this exemplary component may be replaced or supplemented by any other physical feedback device as may be realized by a person of ordinary skill. The sleep warning is output as a haptic alert with the vibrating device 18 during Step E, similar to the audible alert and the visual alert. It is further contemplated that any combination of the audible alert, the visual alert, and the haptic alert may be employed in combination to promote wakefulness in a user.

Figure 8:
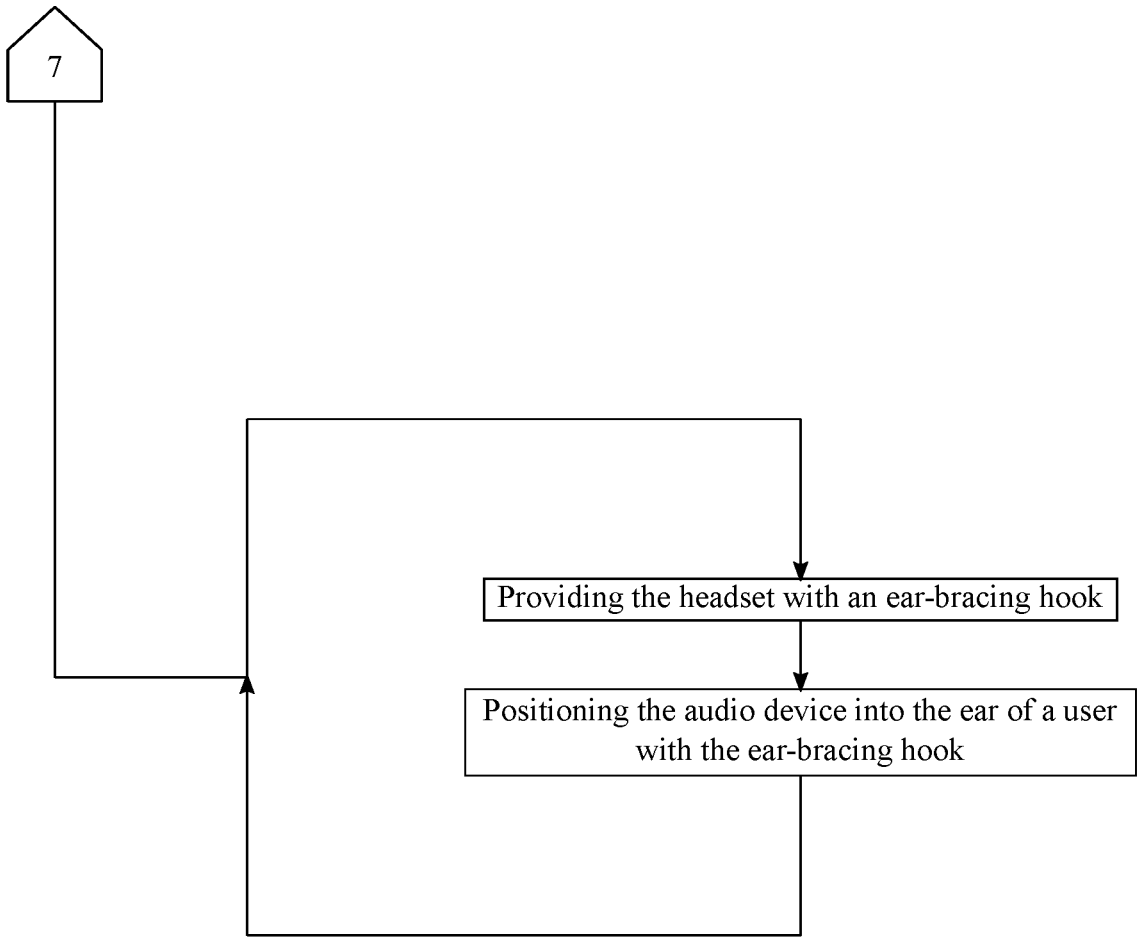
FIG. 8 is a flowchart illustrating a sub-process for applying an attachment structure to fix the system for the present invention into position within a user's ear to improve the efficacy of the audible alert.
Figure 10:
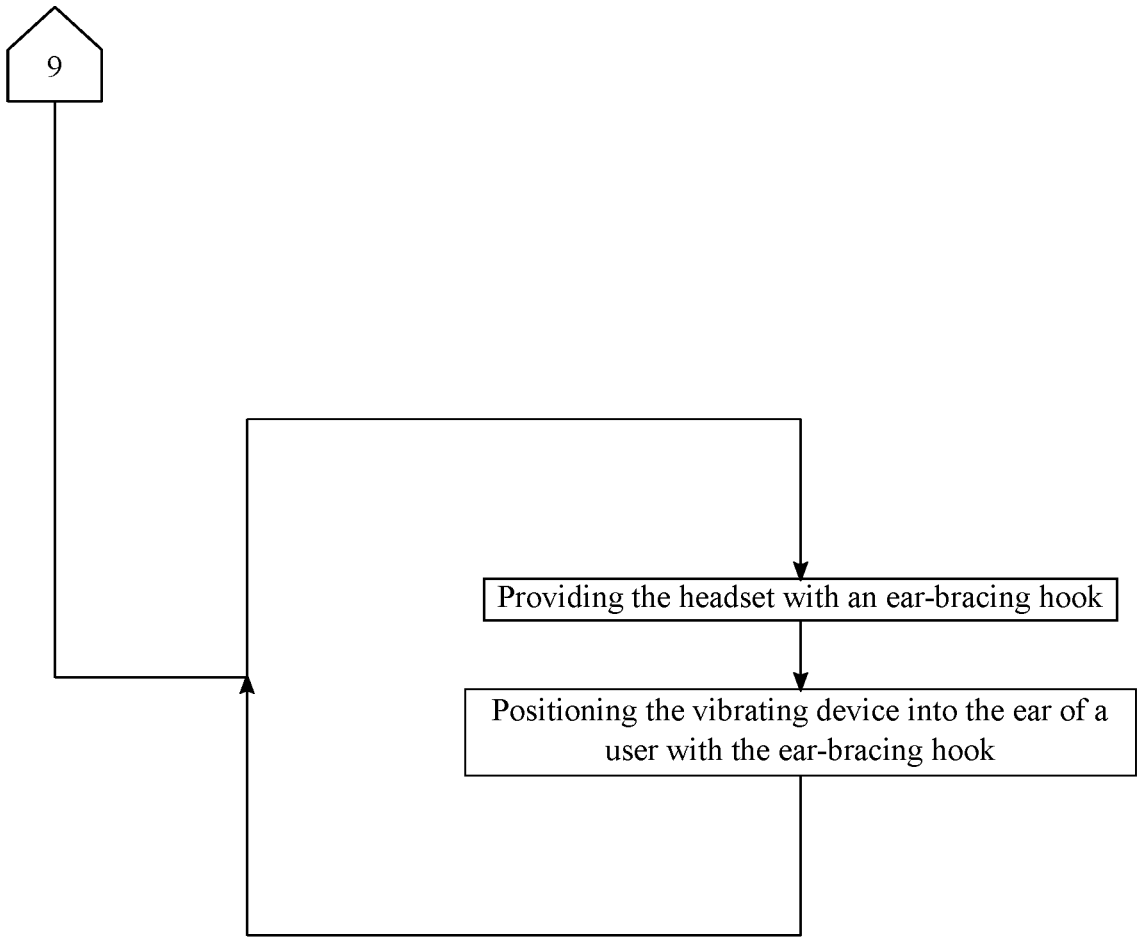
FIG. 10 is a flowchart illustrating a sub-process for applying an attachment structure to fix the system for the present invention into position within a user's ear to improve the efficacy of the haptic alert.

In reference to FIGS. 8 and 10, the present invention is further provided with an ear-bracing hook 17 in at least one embodiment, wherein the ear-bracing hook 17 engages between the headset 10 and the user's outer ear of the user to ensure that the audio device 16 remains in-position within the user's ear. The ear-bracing hook 17 may additionally be configured to support the vibrating device 18, wherein the ear-bracing hook 17 positions the vibrating device 18 into the user's ear. This arrangement ensures that the haptic alert is fully transferred to the user while simultaneously ensuring that the vibration does not dislodge the headset 10 from an operable position on a user's head.

Figure 11:
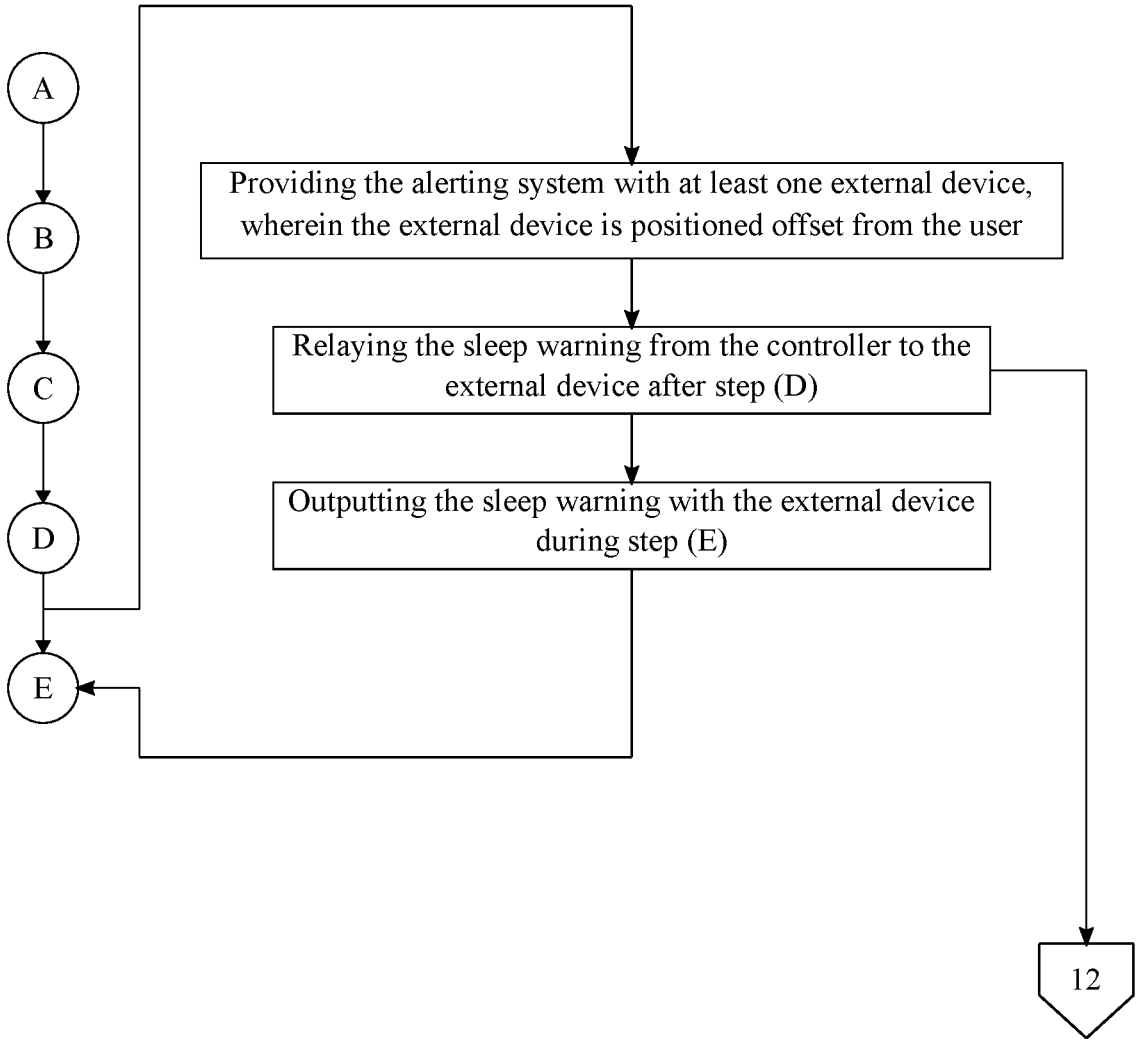
FIG. 11 is a flowchart illustrating a sub-process for integrating various external devices into the system for the present invention.

The alerting system 13 is provided with at least one external device 19 in another embodiment, wherein the external device 19 is positioned offset from the user as outlined in FIG. 11. The external device 19 broadly encompasses any media playback device as may be typically integrated to a wearable device. The external device 19 can be, but is not limited to, car stereo systems, smartphones, portable speakers, display panels, emergency lights, sirens, or any other article that may replicate the functions of the alerting system 13 as described. In this embodiment, the sleep warning is relayed from the controller 11 to the external device 19 after Step D, thereby enabling the external device 19 to act as a surrogate output device for the sleep warning. Accordingly, the sleep warning is outputted with the external device 19 during Step E. It is further proposed that this configuration may be employed in combination with any other embodiment of the alerting system 13 previously described, wherein the external device 19 is used in concert with the other disparate elements of the alerting system 13 to output the sleep warning.

Figure 12:
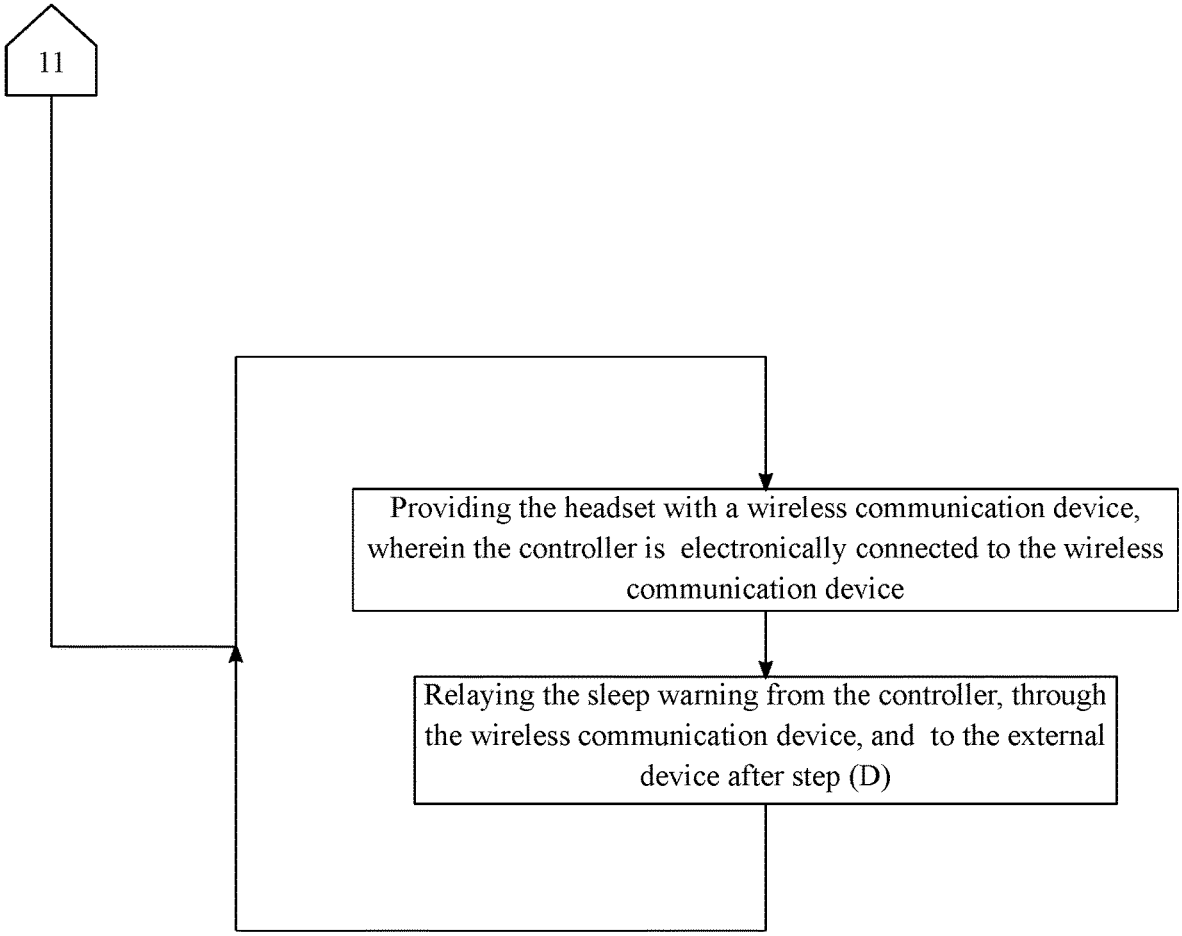
FIG. 12 is a flowchart illustrating a sub-process for wirelessly integrating various external devices into the system for the present invention.

It is understood that the use of wired hardline connections may interfere with the normal use of wearable technology, as the wires may easily become tangled or snagged as a user moves about. As shown in FIG. 12, at least one embodiment of the headset 10 is provided with a wireless communication device 20, wherein the controller 11 is electronically connected to the wireless communication device 20. The wireless communication device 20 preferably defines a short-range transponder configured for communication with other similarly equipped devices, e.g., Bluetooth, Wi-Fi, or other near-field communication systems. In one embodiment, the sleep warning is relayed from the controller 11, through the wireless communication device 20, and to the external device 19 after Step D. This enables the controller 11 to automatically synchronize with a compatible external device 19 to output the sleep warning, as previously described. It is further considered that the wireless communication device 20 may be primarily configured to support conventional hands-free functions, wherein the transmission of the sleep warning is appended as a secondary functionality.

Figure 13:
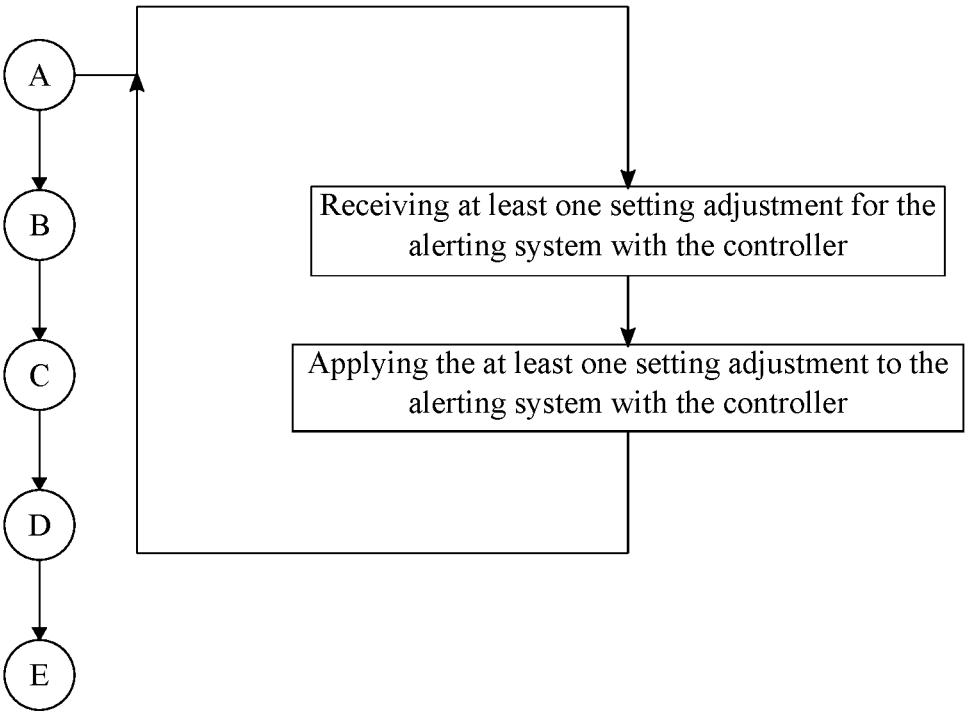
FIG. 13 is a flowchart illustrating a sub-process for enabling a user to configure various operating standards of the system for the present invention.

Referring to FIG. 13, the present invention is described as customizable in the preferred embodiment, wherein the operational thresholds and outputs of the system are ideally user-configured. More specifically, the controller 11 receives at least one setting adjustment for the alerting system 13 and applies setting adjustment to the alerting system 13 with the controller 11. This functionality enables the user to, for example, exchange the audio source file used to generate the audible alert. Or, in another embodiment, the user may configure the pattern and intensity of the visual alert and the haptic alert according to personal preferences. Further, the user may personally configure the allowable range of head inclination to encompass a greater or lesser degree of allowable deviation. The user may also configure the allowable delay of time in response to said deviation, incrementing or decrementing the time delay prior to activation of the alerting system 13.

Although the invention has been explained in relation to its preferred embodiment, it is to be understood that many other possible modifications and variations can be made without departing from the spirit and scope of the invention as hereinafter claimed.

What is claimed is:

1. A method of automatically alerting a user to remain awake, the method comprises the steps of:

(A) providing a headset worn on a head of the user, wherein the headset includes a controller, at least one inclination sensor, an alerting system, and a boom, and wherein the controller is electronically connected to the at least one inclination sensor and the alerting system, and wherein the controller and the inclination sensor is housed within the headset, and wherein the alerting system includes at least one illumination device and at least one audio device, and wherein the illumination device is positioned into a field of view of the user with the boom, and wherein the audio device is lodged into an ear canal of the user, and wherein an allowable range of head inclination is managed by the controller;

(B) receiving a plurality of head inclination readings in a periodic manner with the inclination sensor;

(C) comparing each head inclination reading to the allowable range of head inclination with the controller in order to identify at least one abnormal reading from the plurality of head inclination readings, wherein the abnormal reading is outside of the allowable range of head inclination;

(D) generating a sleep warning with the controller, if the abnormal reading is identified from the plurality of head inclination readings; and (E) outputting the sleep warning with the alerting system by outputting the sleep warning as a visual alert with the illumination device and by outputting the sleep warning as an audible alert with the audio device.

2. The method of automatically alerting a driver to remain alert and awake, the method as claimed in claim 1 comprises the steps of:

providing an allowable delay of time managed by the controller; and executing step (D), if the at least one abnormal reading includes a series of abnormal readings, and if each pair of abnormal readings within the series of abnormal readings includes a first abnormal reading and a second abnormal reading, and if a lapsed period of time between the first abnormal reading and the second abnormal reading is greater than the allowable delay of time.

3. The method of automatically alerting a driver to remain alert and awake, the method as claimed in claim 1 comprises the steps of:

providing the alerting system with at least one vibrating device, wherein the vibrating device is lodged into an ear canal of the user; and outputting the sleep warning as a haptic alert with the vibrating device during step (E).

4. The method of automatically alerting a driver to remain alert and awake, the method as claimed in claim 3 comprises the steps of:

providing the headset with an ear-bracing hook; and positioning the vibrating device into the ear of the user with the ear-bracing hook.

5. The method of automatically alerting a driver to remain alert and awake, the method as claimed in claim 1 comprises the steps of:

providing the alerting system with at least one external device, wherein the external device is positioned offset from the user;

relaying the sleep warning from the controller to the external device after step (D); and outputting the sleep warning with the external device during step (E).

6. The method of automatically alerting a driver to remain alert and awake, the method as claimed in claim 5 comprises the steps of:

providing the headset with a wireless communication device, wherein the controller is electronically connected to the wireless communication device; and relaying the sleep warning from the controller, through the wireless communication device, and to the external device after step (D).

7. The method of automatically alerting a driver to remain alert and awake, the method as claimed in claim 1 comprises the steps of:

receiving at least one setting adjustment for the alerting system with the controller; and applying the at least one setting adjustment to the alerting system with the controller.

8. A method of automatically alerting a user to remain awake, the method comprises the steps of:

(A) providing a headset worn on a head of the user, wherein the headset includes a controller, at least one inclination sensor, an alerting system, a boom, and an ear-bracing hook, and wherein the controller is electronically connected to the at least one inclination sensor and the alerting system, and wherein the controller and the inclination sensor is housed within the headset, and wherein the alerting system includes at least one illumination device, at least one audio device, and at least one vibrating device, and wherein the illumination device is positioned into a field of view of the user with the boom, and wherein the audio device is lodged into an ear canal of the user, and wherein the vibrating device is lodged into the ear canal of the user, and wherein an allowable range of head inclination is managed by the controller;

(B) receiving a plurality of head inclination readings in a periodic manner with the inclination sensor;

(C) comparing each head inclination reading to the allowable range of head inclination with the controller in order to identify at least one abnormal reading from the plurality of head inclination readings, wherein the abnormal reading is outside of the allowable range of head inclination;

(D) generating a sleep warning with the controller, if the abnormal reading is identified from the plurality of head inclination readings; and (E) outputting the sleep warning with the alerting system by outputting the sleep warning as a visual alert with the illumination device and by outputting the sleep warning as an audible alert with the audio device and by outputting the sleep warning as a haptic alert with the vibrating device.

9. The method of automatically alerting a driver to remain alert and awake, the method as claimed in claim 8 comprises the steps of:

providing an allowable delay of time managed by the controller; and executing step (D), if the at least one abnormal reading includes a series of abnormal readings, and if each pair of abnormal readings within the series of abnormal readings includes a first abnormal reading and a second abnormal reading, and if a lapsed period of time between the first abnormal reading and the second abnormal reading is greater than the allowable delay of time.

10. The method of automatically alerting a driver to remain alert and awake, the method as claimed in claim 8 comprises the steps of:

providing the alerting system with at least one external device, wherein the external device is positioned offset from the user;

relaying the sleep warning from the controller to the external device after step (D); and outputting the sleep warning with the external device during step (E).

11. The method of automatically alerting a driver to remain alert and awake, the method as claimed in claim 10 comprises the steps of:

providing the headset with a wireless communication device, wherein the controller is electronically connected to the wireless communication device; and relaying the sleep warning from the controller, through the wireless communication device, and to the external device after step (D).

12. The method of automatically alerting a driver to remain alert and awake, the method as claimed in claim 8 comprises the steps of:

receiving at least one setting adjustment for the alerting system with the controller; and applying the at least one setting adjustment to the alerting system with the controller.

* * * * *